US010199704B2

(12) United States Patent
Tkadlec et al.

(10) Patent No.: US 10,199,704 B2
(45) Date of Patent: Feb. 5, 2019

(54) METHOD FOR COMPENSATING A TEMPERATURE DRIFT OF A MICROWAVE FILTER

(71) Applicant: Andrew Wireless Systems GmbH, Buchdorf (DE)

(72) Inventors: Roman Tkadlec, Pardubice (CZ); Frantisek Hrnicko, Pardubice (CZ); Gabriel Toth, Pardubice (CZ)

(73) Assignee: Andrew Wireless Systems GmbH, Buchdorf (DE)

( * ) Notice: Subject to any disclaimer, the term of this patent is extended or adjusted under 35 U.S.C. 154(b) by 118 days.

(21) Appl. No.: 15/115,604

(22) PCT Filed: Jan. 19, 2015

(86) PCT No.: PCT/EP2015/050861

§ 371 (c)(1),
(2) Date: Jul. 29, 2016

(87) PCT Pub. No.: WO2015/113844

PCT Pub. Date: Aug. 6, 2015

(65) Prior Publication Data

US 2017/0170536 A1 Jun. 15, 2017

(30) Foreign Application Priority Data

Jan. 31, 2014 (EP) ..... 14153459

(51) Int. Cl.
*H01P 1/30* (2006.01)
*H01P 1/205* (2006.01)
(Continued)

(52) U.S. Cl.
CPC ..... *H01P 1/30* (2013.01); *H01P 1/207* (2013.01); *H01P 1/208* (2013.01); *H01P 1/2053* (2013.01); *H01P 7/06* (2013.01)

(58) Field of Classification Search
CPC .... H01P 1/208; H01P 1/30; H01P 7/06; H01P 1/2053; H01P 1/207
(Continued)

(56) References Cited

U.S. PATENT DOCUMENTS 4,726,071 A 2/1988 Jachowski
5,691,677 A 11/1997 De et al.

FOREIGN PATENT DOCUMENTS

CN 1129995 A 8/1996
CN 101740843 A 6/2010
(Continued)

OTHER PUBLICATIONS

Wang et al.; "Temperature Compensation of Combine Resonators and Filters"; 1999.*

(Continued)

*Primary Examiner* — Rakesh Patel
(74) *Attorney, Agent, or Firm* — Fogg & Powers LLC

(57) ABSTRACT

A method for compensating a temperature drift of a microwave filter comprises: measuring a first frequency response of a microwave filter at a first temperature; determining values of elements of an equivalent circuit corresponding to the microwave filter such that a first modelled frequency response computed using the equivalent circuit matches the first measured frequency response to obtain a first model modelling the microwave filter at the first temperature: measuring a second frequency response of the microwave filter at a second temperature; determining values of elements of the equivalent circuit corresponding to the microwave filter anew such that a second modelled frequency response computed using the equivalent circuit matches the second measured frequency response to obtain a second model modelling the microwave filter at the second temperature; and adjusting an overall temperature drift of the
(Continued)

microwave filter to adjust the temperature drifts of the resonant filter elements.

11 Claims, 4 Drawing Sheets

(51) Int. Cl.
*H01P 7/06* (2006.01)
*H01P 1/208* (2006.01)
*H01P 1/207* (2006.01)

(58) Field of Classification Search
USPC ..... 333/206, 207, 227, 229
See application file for complete search history.

(56) References Cited

FOREIGN PATENT DOCUMENTS

| | | |
|---|---|---|
| EP | 2413510 | 2/2012 |
| JP | 2006042144 A | 2/2006 |

OTHER PUBLICATIONS

International Search Authority, "International Search Report and Written Opinion for PCT Application No. PCT/EP2015/050861", dated Apr. 17, 2015, pp. 1-10, Published in: WO.

Meng et al., "Tuning Space Mapping: A Novel Technique for Engineering Design Optimization", "Microwave Symposium Digest, 2008 IEEE MTT-S International", Jun. 15, 2008, pp. 991-994, Publisher: IEEE.

State Intellectual Property Office of the People's Republic of China, "First Office Action from CN Appln. No. 201580011252.7 dated Apr. 24, 2018", from Foreign Counterpart of U.S. Appl. No. 15/115,604 dated: Apr. 24, 2018, pp. 1-10, Published: CN.

European Patent Office, "Communication Pursuant to Article 94(3) from EP Application No. 14153459.4 dated Oct. 26, 2018" From Foreign Counterpart of U.S. Appl. No. 15/115,604; pp. 1-4; Published in EP.

* cited by examiner

METHOD FOR COMPENSATING A TEMPERATURE DRIFT OF A MICROWAVE FILTER

CROSS-REFERENCE TO RELATED APPLICATIONS

This application is a U.S. National Stage application of PCT Application Serial No. PCT/EP2015/050861, filed Jan. 19, 2015, which claims the benefit of EP Patent Application Serial No. 14153459.4, filed Jan. 31, 2014, the contents of all of which are hereby incorporated by reference.

FIELD OF INVENTION

The invention relates to a method for compensating a temperature drift of a microwave filter, in particular a microwave cavity filter.

BACKGROUND OF THE INVENTION

Such microwave filters are for example employed in wireless communication and may for example realize a bandpass or bandstop filter. In this regard, continuous growth in wireless communication in recent decades has caused more advanced, stricter requirements on filters and on other equipment in a communication system. In particular, filters with a narrow bandwidth, a low insertion loss and a high selectivity are required, wherein such filters must be operable in a wide temperature range. In general, filters must operate at low temperatures in cold environments as well as at elevated temperatures for example after warming of components of a communication system during operation.

To fulfill such requirements, typically microwave filters with a multiplicity of a resonant filter elements, in particular resonant filter cavities, electromagnetically coupled to each other are used. In such filters, in order to fulfill required specifications in an operational temperature range, a mechanism is required to stabilize a resonant frequency against a temperature drift. For this, a housing and a resonator element, for example a resonator rod, of a filter element may be made of materials with different coefficients of thermal expansion (CTE) in order to stabilize the resonant frequency of the entire filter. However, typically such resonant frequency temperature compensation is based on the assumption that all resonant filter elements of the filter resonate at the same frequency. This typically may not be true because as a result of filter synthesis each resonant filter element of a filter may resonate at a slightly different frequency. Consequently, different resonant filter elements may have a different resonant frequency drift caused by temperature variations, possibly resulting in a degradation of filter performance.

Recently proposed topologies called cul-de-sac having a minimum number of couplings for a given response and no diagonal couplings typically are even more temperature sensitive than conventional topologies and require a very precise temperature compensation to profit from their advantages.

There consequently is a need for a method to allow a fine temperature compensation at each single resonant filter element in order to compensate for assembly, mechanical and material tolerances. It in general can be assumed that a filter response can be considered as temperature compensated when all of its resonant filter elements are reasonably well temperature compensated.

Temperature compensated filters may for example employ materials with a low thermal expansion coefficient, for example so called Invar materials. Such materials however are costly. Another option is to combine different materials having suitable thermal expansion coefficients.

Cost-effective coaxial resonator cavities may for example employ a housing of an aluminum alloy comprising a resonator element and a tuning screw made of brass or steel. By computer simulation the dimensions of a resonant cavity may be determined so that the cavity is compensated against frequency drift at its nominal resonator dimensions, at the nominal values of the thermal expansion coefficient and at its nominal frequency. Due to production variances and mechanical and material tolerances, however, different resonant cavities may exhibit different resonant frequency temperature drifts deviating from the nominal resonant frequency temperature drift. This impacts the performance of the overall filter, leading to a degradation in filter performance.

In general, a temperature compensation of a single resonant filter element or of several separate resonant filter elements coupled to a main microwave line is simple and straightforward because the frequency drift of each resonant filter element caused by temperature changes is separated from other resonant filter elements, such that the effects of tuning can be clearly distinguished for the different resonant filter elements. However, more complicated situations occur when multiple resonant filter elements are crossed-coupled, in particular for cul-de-sac topologies in which it by means of currently known technics is practically impossible to distinguish a frequency drift of the particular resonant filter elements from the overall filter response.

The synthesis of microwave filters, in particular microwave cavity filters employing a cul-de-sac topology, is for example described in articles for example by Cameron et al. ("Synthesis of advanced microwave filters without diagonal cross-couplings", IEEE Trans. MTT, Vol. 50, No. 12, December 2002), by Fathelbab ("Synthesis of cul-de-sac filter networks utilizing hybrid couplers", IEEE Microwave and Wireless Components Letters, Vol. 17, No. 5, May 2007) and by Corrales et al. ("Microstrip dual-band bandpass filter based on the cul-de-sac topology", Proceedings of the 40. European Microwave Conference, September 2010). In an article by Wang et al. ("Temperature compensation of combline resonators and filters", IEEE MTT-S Digest, 1999) a method for temperature compensation of a resonator is modeled, the resonator comprising a tuning screw and a resonator rod being cylindrical in shape and being arranged in a cavity.

From U.S. Pat. No. 6,734,766 a microwave filter having a temperature compensating element is known. The microwave filter includes a housing wall structure, a filter lid, a resonator rod, a tuning screw and a temperature compensating element. The temperature compensating element is joined to the filter lid or the housing and forms a bimetallic composite with the filter lid or housing that deforms with a changed in ambient temperature.

From U.S. Pat. No. 5,233,319 a dielectric resonator is known which comprises two tuning screws, one of which is metallic and the other one of which is dielectric. The two tuning screws are movable with respect to a housing, wherein by moving the metallic tuning screw into the housing a resonant frequency of the resonator can be tuned up, whereas by moving the dielectric tuning screw into the housing a resonant frequency of the resonator may be lowered.

BRIEF DESCRIPTION OF THE DRAWINGS

The idea underlining the invention shall subsequently be described in more detail with respect to the embodiments shown in the figures. Herein.

DETAILED DESCRIPTION

Figure 1A:
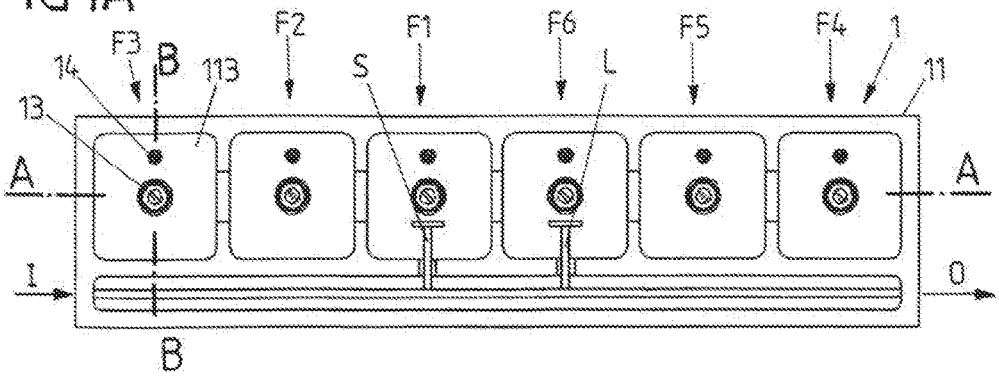
FIG. 1A shows a top view of a microwave filter comprising a multiplicity of resonant filter elements in the shape of microwave cavities.

It is an object of the instant invention to provide a method which allows in an easy, automatable way for a tuning of resonant filter elements of a microwave filter in order to compensate the overall filter for a temperature drift.

This object is achieved by a method comprising the features described herein.

Herein a method for compensating a temperature drift of a microwave filter is provided, the method comprising:

- measuring a first frequency response of a microwave filter comprising multiple resonant filter elements at a first temperature to obtain a first measured frequency response,
- optimizing an equivalent circuit corresponding to the microwave filter such that a first modelled frequency response computed using the equivalent circuit matches the first measured frequency response to obtain a first model modelling the microwave filter at the first temperature,
- measuring a second frequency response of the microwave filter at a second temperature to obtain a second measured frequency response,
- optimizing the equivalent circuit corresponding to the microwave filter anew such that a second modelled frequency response computed using the equivalent circuit matches the second measured frequency response to obtain a second model modelling the microwave filter at the second temperature,
- determining a temperature drift of a resonant frequency of each of the multiple resonant filter elements using the first model and the second model, and
- adjusting an overall temperature drift of the microwave filter by using tuning mechanisms on at least some of the multiple resonant filter elements to adjust the temperature drifts of the resonant filter elements.

The instant invention is based on the idea to use a two-step approach to achieve a temperature drift compensation of a microwave filter. Herein, in a first step a filter response is analysed at different temperatures, for example at room temperature and at one or multiple temperatures above room temperature, so that information about the frequency drift of each resonant filter element comprised in the filter is obtained. Once the frequency drift of each particular resonant filter element of the filter is known, the resonant filter elements can be compensated independently from each other. In a second step, then, a proper temperature drift compensation is achieved by employing a suitable tuning mechanism designed to enable a fine temperature drift compensation of a coarsely compensated resonator.

In the context of the method, a frequency response of a microwave filter is measured at a first temperature, for example room temperature, to obtain a first measured frequency response. In addition, a second frequency response of the microwave filter is measured at a second temperature, for example a temperature well above room temperature, to obtain a second measured frequency response. Said first measured frequency response and said second measured frequency response are then used to optimize an equivalent circuit of the microwave filter, the equivalent circuit comprising a number of circuit elements modelling the behavior of the microwave filter with its multiple coupled resonant filter elements. Herein, the equivalent circuit is optimized in order to determine values of its circuit elements such that a modelled frequency response computed using the equivalent circuit at least approximately matches the first measured frequency response. In addition, the equivalent circuit is optimized by determining a different set of values of its circuit elements such that its modelled frequency response matches the second measured frequency response. In this way a first model modelling the microwave filter at the first temperature, for example room temperature, and a second model modelling the microwave filter at a second temperature, for example a temperature well above room temperature, are obtained. This may be repeated for further temperatures such that further models modelling the microwave filter at other temperatures are additionally obtained. From the different models, then, the resonant frequencies and coupling coefficients at the different temperatures can be computed and stored for each resonant filter element and each coupling there between. From this, then, a temperature drift of the resonant frequency for each of the multiple resonant filter elements may be determined.

Once the temperature drift of the single resonant filter elements is known, such resonant filter elements may be compensated separately. For this, on one or multiple of the resonant filter elements a suitable tuning mechanism is used which in a suitable way compensates for the temperature drift of the particular resonant filter elements. If all resonant filter elements are well compensated with respect to their temperature drift, also the overall microwave filter will be compensated for its temperature drift.

The microwave filter may for example comprise multiple resonant filter cavities forming the resonant filter elements. Such cavities are defined by a wall structure of a housing of the microwave filter and may be electromagnetically coupled to each other by openings in the wall structure.

When computing the frequency response of the microwave filter at a particular temperature, parameters of a scattering matrix (the so-called S-matrix) may for example be determined and stored. The scattering matrix herein is determined for each temperature when measuring the frequency responses at the different temperatures.

Each resonant filter element beneficially is associated with a tuning mechanism serving to tune the resonant filter element such that it exhibits a suitable temperature drift, advantageously a low temperature drift. Such tuning mechanism herein may be designed in different ways.

In a first variant, the tuning mechanism of a resonant filter element may comprise one tuning element arranged on a housing of the resonant filter element, wherein the temperature drift of the associated resonant filter element is compensated for by selecting the material and/or shape of the tuning element. The tuning element—for example a tuning screw, made of a metal such as brass, steel or an aluminium alloy or made of a dielectric material—on the one hand serves to tune the filter element to a desired resonant frequency. By in addition properly choosing the material of the tuning element and/or the shape of the tuning element, a temperature drift compensation may be achieved in that the resonant filter element is compensated for a temperature drift at the desired resonant frequency.

In a second variant, the tuning mechanism of a resonant filter element comprises at least two tuning elements arranged on a housing of the resonant filter element. Each tuning element extends into a cavity of the resonant filter element with a shaft portion, wherein the tuning elements are movable with respect to the housing along an adjustment direction to adjust the length of the shaft portion extending into the housing. The tuning elements, in principle, may be movable in a coupled fashion such that for example one tuning element is moved into the housing while at the same time the other tuning element is moved out of the housing. Beneficially, however, the tuning elements are movable with respect to the housing independent of each other.

Figure 1B:
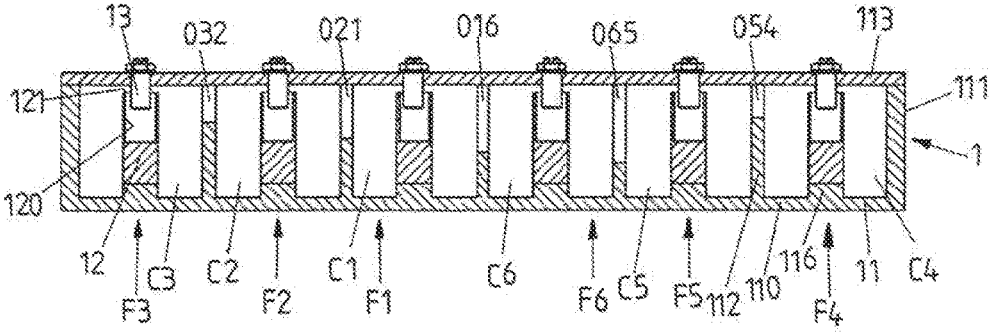
FIG. 1B shows a sectional view of the microwave filter along line A-A according to FIG. 1A.

FIGS. 1A and 1B show a microwave filter 1 being constituted as a microwave cavity filter. The microwave filter 1 comprises a multiplicity of resonant filter elements F1-F6 each having one resonant microwave cavity C1-C6. The microwave filter 1 may for example realize a bandstop filter having a predefined stopband or a bandpass filter having a predefined passband.

The cavities C1-C6 of the filter elements F1-F6 of the microwave filter 1 are formed by a wall structure 110-115 of a housing 11 of the microwave filter 1. The housing 11 comprises a bottom wall 110 from which side walls 111, 112, 114, 115 (see FIGS. 1B and 3) extend vertically. The housing 11 further comprises a lid forming a top wall 113 covering the microwave filter 1 at the top.

The cavities C1-C6 of neighbouring filter elements F1-F6 are connected to each other via openings O32, O21, O16, O65, O54 in the wall structure separating the different cavities C1-C6 such that neighbouring cavities C1-C6 are electromagnetically coupled. The microwave filter 1 has a so called cul-de-sac topology in that the filter elements F1-F6 are arranged in a row and a coupling to a mainline M is provided at the two inner most filter elements F1, F6 (source S and load L). A microwave signal hence may be coupled via an input I into the mainline M, is coupled into the microwave filter 1 and is output at an output O.

Each resonant filter element F1-F6, in its filter cavity C1-C6, comprises a resonator element 12 extending from an elevation 116 on the bottom wall 110 into the cavity C1-C6 such that the resonator element 12, for example formed as a rod having a circular or quadratic cross-section, centrally protrudes into the cavity C1-C6.

Generally, the resonant frequency of a resonant filter element F1-F6 is determined by the dimensions of the cavity C1-C6 and the resonator element 12 arranged in the cavity C1-C6. In order to be able to tune the resonant frequency of the filter elements F1-F6, herein on each resonant filter element F1-F6 a tuning element 13 in the shape of a tuning screw is provided. The tuning element 13 is arranged on a top wall 113 of the corresponding cavity C1-C6 and comprises a shaft portion 132 which may be moved into or out of the cavity C1-C6 in order to adjust the resonant frequency of the corresponding resonant filter element F1-F6.

The resonant frequencies of the single resonant filter elements F1-F6 in combination then determine the resonant behaviour of the overall microwave filter 1 and hence the shape of e.g. a passband or a stopband.

Figure 2:
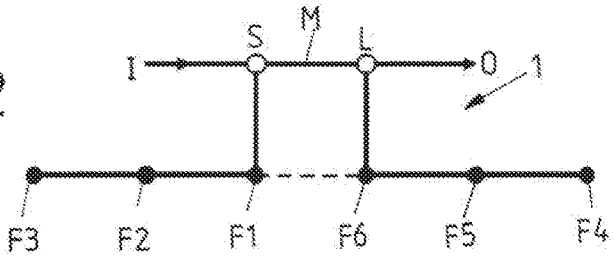
FIG. 2 shows a schematic functional drawing of the microwave filter.

A schematic view of the microwave filter 1 indicating the functional arrangement of the single resonant filter elements F1-F6 is shown in FIG. 2, depicting the coupling between the filter elements F1-F6 and the mainline M.

Figure 3:
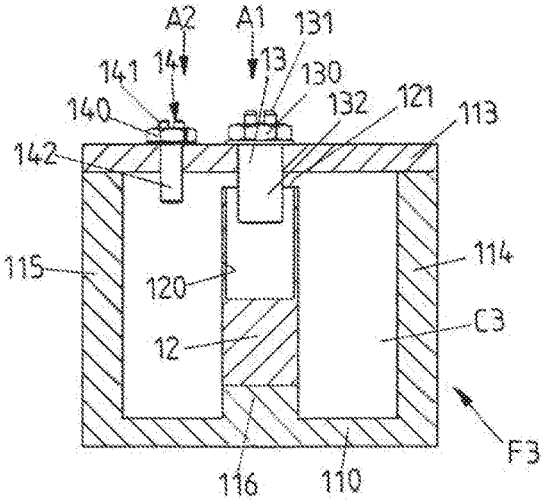
FIG. 3 shows a sectional view along line B-B according to FIG. 1A.

As shown in FIG. 3, each resonant filter element F1-F6 in the instant example comprises, in addition to the first tuning element 13, a second tuning element 14 having a shaft portion 142 extending into the corresponding cavity C1-C6. The tuning elements 13, 14 together make up a tuning mechanism which allows on the one hand for the tuning of the resonant frequency of the associated filter element F1-F6 and on the other hand for a fine compensation of the temperature drift of the resonant filter element F1-F6 in order to obtain a favourable temperature behaviour of the resonant filter element F1-F6.

As shown in FIG. 3, each tuning element 13, 14 comprises a shaft portion 132, 142 extending into the corresponding cavity C1-C6 of the filter element F1-F6. Outside of the cavity C1-C6 a head 131, 141 of the tuning element 13, 14 is placed via which a user may act onto the tuning element 13, 14 to screw it into or out of the cavity C1-C6. The tuning elements 13, 14 are held on the top wall 113 by means of a nut 131, 141. The tuning elements 13, 14 are movable with respect to the top wall 113 of the housing 11 of the filter element F1-F6 along an adjustment direction A1, A2 and each are formed as a screw such that by turning the respective tuning element 13, 14 about its adjustment direction A1, A2 a longitudinal adjustment along the corresponding adjustment direction A1, A2 is obtained. By means of such longitudinal adjustment, the length of the shaft portion 132, 142 of the tuning element 13, 14 extending into the cavity C1-C6 can be varied.

In general, a temperature drift compensation of a single resonant filter element F1-F6 which is not coupled to any other resonant filter elements F1-F6 and hence can be regarded separately from other filter elements F1-F6 is rather easy. However, for a multiplicity of filter elements F1-F6 cross-coupled to each other as for example in the microwave filter 1 of FIGS. 1A and 1B, such compensation is not possible in an easy and intuitive manner. Hence, a method is proposed herein which allows for determining how a tuning mechanism 13, 14 of a single resonant filter element F1-F6 must be adjusted in order to obtain a favourable temperature drift compensation of the overall microwave filter 1.

Figure 4:
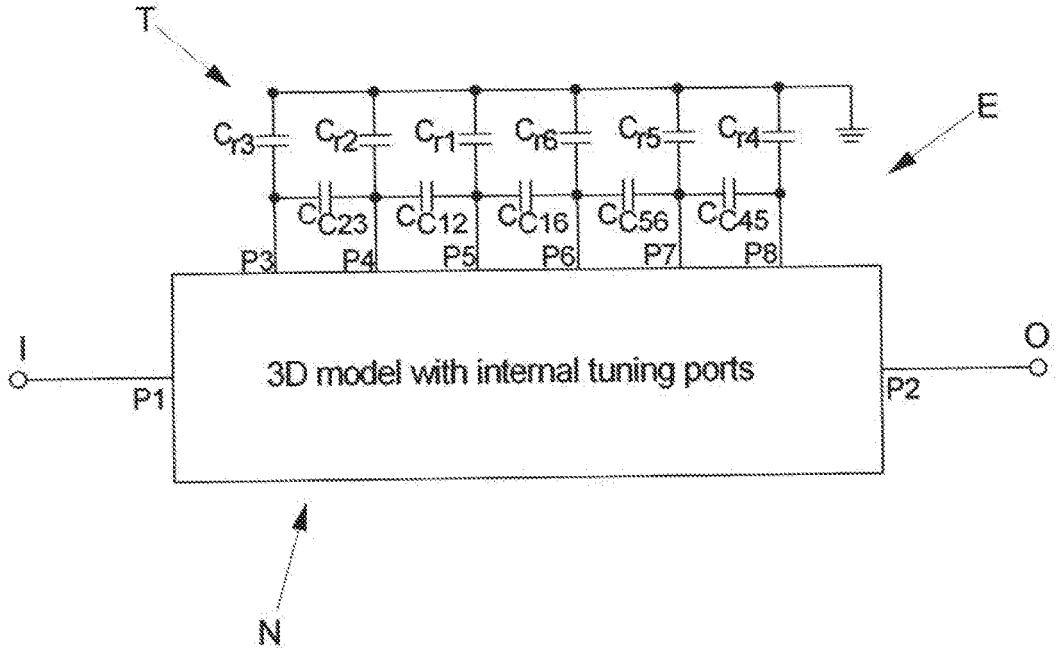
FIG. 4 shows a schematic drawing of an equivalent circuit of a microwave filter, representing a cul-de-sac filter including six resonant filter elements.

For this, it is noted that a microwave filter 1 may be represented by an equivalent circuit E as shown schematically in an example in FIG. 4. In such equivalent circuit E the microwave filter 1 is divided into two models, namely a physical model N modelling the actual 3D structure of the microwave filter 1 and a tuning model T including coupling capacitances $C_{C12}$-$C_{C16}$ and resonant capacitances $C_{r1}$-$C_{r6}$.

Figure 5:
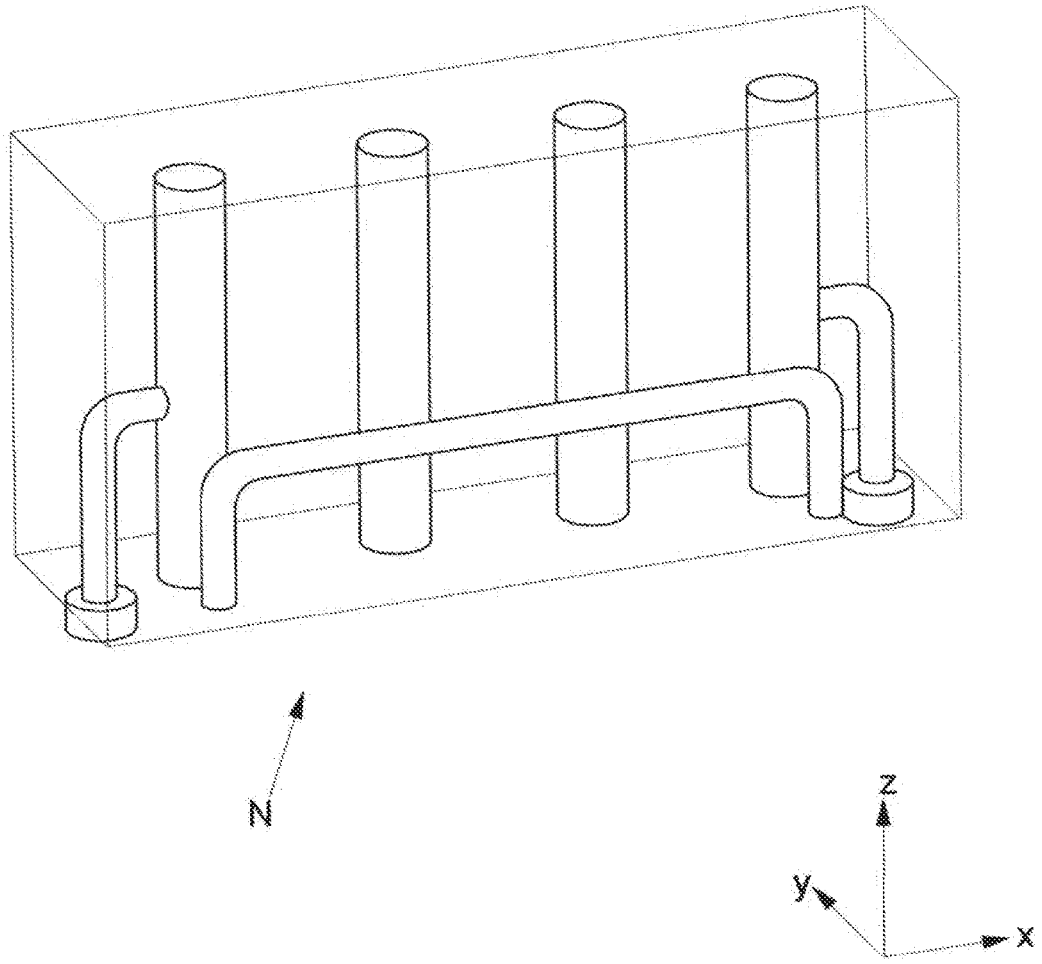
FIG. 5 shows a 3D model of a microwave filter as used in the equivalent circuit representation of FIG. 4.

Within such equivalent circuit E the 3D model N models the physical behaviour of the microwave filter 1 by modelling its physical structure in, for example, a full-wave 3D electromagnetic simulator, such as a finite-element or finite-differences simulation tool. An example of a 3D model used in such a simulation tool is shown in FIG. 5. The physical behaviour of the microwave filter 1 herein is described by an n-port S-parameter matrix computed using the physical 3D model, in the instant example a cul-de-sac filter topology having six resonant filter elements F1-F6 and an 8-port S-parameter matrix having ports P1-P8.

The instant approach is based on a concept described for example by Meng et al. ("Tuning space mapping: A model technique for engineering design optimization", IEEE MTT-S Int. Microwave Symp. Dig., Atlanta, Ga., 2008, pp. 991-994) and Koziel et al. ("Space mapping", IEEE Microwave Magazine, December 2008), which references shall be incorporated herein by reference. According to this concept, a tuning model T is incorporated into the physical 3D model N modelling the physical structure of the device to be optimized. The elements of the tuning model T, namely the resonant capacitances $C_{r1}$-$C_{r6}$ and the coupling capacitances $C_{c12}$-$C_{c56}$, are tuneable in the model in order to optimize the overall model with respect to a desired target. This approach is advantageous since in general the physical 3D model N is computationally expensive, whereas the optimization of a tuning model T with its limited number of elements $C_{r1}$-$C_{r6}$ and $C_{c12}$-$C_{c56}$ takes little effort as the tuning model T typically may be implemented, for example, within a circuit simulator.

Figure 6A:
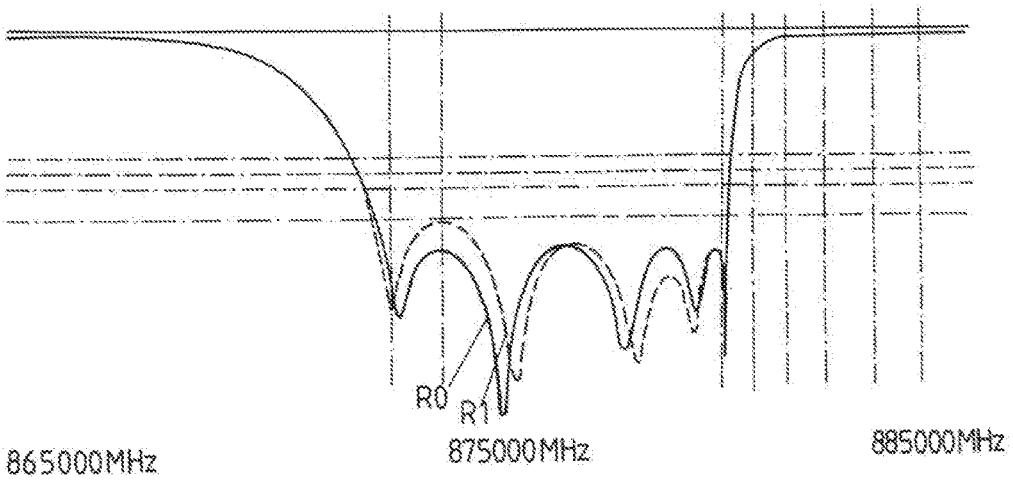
FIG. 6A shows a measured frequency response of a microwave filter, before temperature drift compensation.

The general approach using such equivalent circuit E for fine compensating the microwave filter 1 is then as follows:

First, a frequency response of the microwave filter 1 is measured as shown in FIG. 6A. From the measured frequency response the scattering matrix (S-parameter matrix) for the microwave filter 1 is determined and stored.

According to the scattering matrix of the actual microwave filter 1, then, the equivalent circuit E can be optimized by adjusting the elements $C_{r1}$-$C_{r6}$ and $C_{c12}$-$C_{c56}$ of the tuning model T of the equivalent circuit E such that its behaviour at least approximately matches the physical behaviour of the microwave filter 1 as measured (for this, it is assumed that the 3D model has been computed prior, resulting in an n-port S-parameter matrix representing the 3D model N). In other words, the equivalent circuit E is optimized such that its computed frequency response at least approximately matches the measured frequency response of the microwave filter 1.

This can be done for different temperatures. For example, first the frequency response can be measured at room temperature (curve R0 in FIG. 6A), and the equivalent circuit E can be optimised to this measured frequency response R0 to obtain a first model modelling the microwave filter 1 at room temperature. Then, a second frequency response at an elevated temperature, for example above 50° C., can be measured, and the equivalent circuit E can be optimised such that its computed frequency response models the measured frequency response at the elevated temperature. In his way a second model is obtained.

From the determined models for each resonant filter element F1-F6 a drift of the resonant frequency with temperature can be determined and stored. Further, a drift of the coupling between the filter elements F1-F6 with temperature can be determined and stored. Hence, a list of the resonant frequency temperature drift for each separate filter element F1-F6 can be determined and stored.

As an outcome of such steps, the temperature drift of the resonant frequency of each filter element F1-F6 is known. With this knowledge, the temperature drift of each resonant filter element F1-F6 can be compensated. Once the temperature drift for each filter element F1-F6 is compensated, also the temperature drift of the overall microwave filter 1 will be compensated.

Figure 6B:
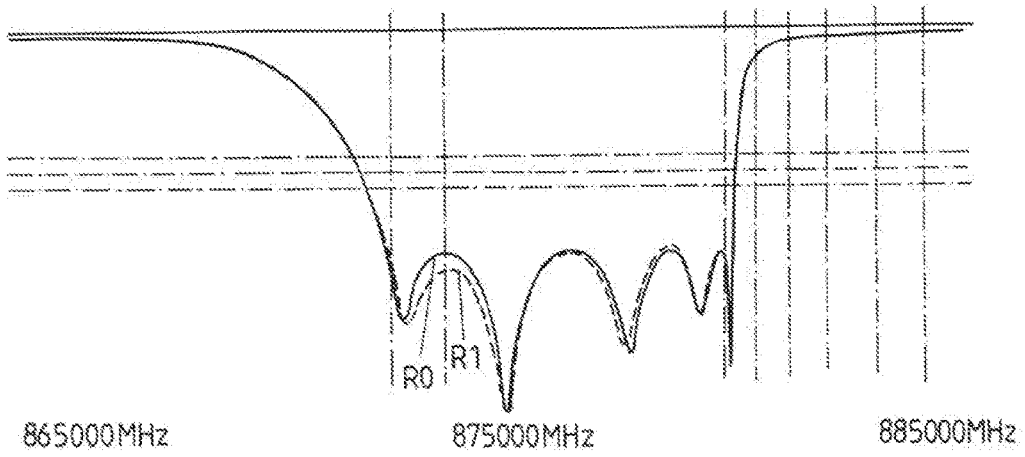
FIG. 6B shows a measured frequency response of a microwave filter, after temperature drift compensation.

If the temperature drift of each resonant filter element F1-F6 is compensated appropriately, also the overall microwave filter 1 will exhibit a behaviour having a desired (minimum) temperature drift. This is shown in FIG. 6B depicting the measured frequency response R0 at room temperature and the measured frequency response R1 at an elevated temperature. Such curves are almost matched to each other.

In order to compensate for the temperature drift and in order to tune a resonant filter element F1-F6 with its cavity C1-C6 such that at the nominal resonant frequency a temperature drift of approximately zero is obtained, in the embodiment of FIG. 3 a tuning mechanism is provided comprising two tuning elements 132, 142 in the shape of tuning screws which are asymmetrically arranged on the top wall 113 of the housing 114 of the resonant filter element F1-F6 and can be adjusted independently to minimize temperature frequency drift of the cavity C1-C6.

The idea underlying the invention is not limited to the embodiments described above, but may be implemented also in entirely different embodiments. In particular, other arrangements of filter elements to form a microwave filter are conceivable. The instant invention is in particular not limited to filters having a cul-de-sac topology.

LIST OF REFERENCE NUMERALS

1 Microwave filter
11 Housing
110-115 Housing wall
116 Elevation
12 Resonator element
120, 122 Opening
121 Top face
13, 14 Tuning element
130, 140 Nut
131, 141 Screw head
132, 142 Shaft
143 End piece
A1, A2 Adjustment direction
C1-C6 Cavity
$C_{c12}$, $C_{c23}$, $C_{c45}$, $C_{c56}$, $C_{c16}$ Coupling capacitance
$C_{r1}$-$C_{r6}$ Resonant capacitance
E Equivalent circuit
F1-F6 Resonant filter elements
I Input
L Output (load)
M Main line
N 3D model
O Output
O32, O21, O16, O65, O54 Opening
P1-P8 Port
R0, R1 Frequency response
S Input (source)
T Tuning model

The invention claimed is:

1. A method for compensating a temperature drift of a microwave filter, the method comprising:

measuring a first frequency response of the microwave filter comprising multiple resonant filter elements at a first temperature to obtain a first measured frequency response, adjusting model elements in an equivalent circuit corresponding to the microwave filter such that a first modelled frequency response computed using the equivalent circuit matches the first measured frequency response to obtain a first model modelling the microwave filter at the first temperature, measuring a second frequency response of the microwave filter at a second temperature to obtain a second measured frequency response, adjusting the model elements in the equivalent circuit corresponding to the microwave filter such that a second modelled frequency response computed using the equivalent circuit matches the second measured frequency response to obtain a second model modelling the microwave filter at the second temperature, determining a temperature drift of a resonant frequency for each of the multiple resonant filter elements using the first model and the second model, and adjusting an overall temperature drift of the microwave filter by using tuning mechanisms on at least one of the multiple resonant filter elements to adjust the temperature drifts of the resonant filter elements.

2. The method according to claim 1, wherein the equivalent circuit models the multiple resonant filter elements of the microwave filter.

3. The method according to claim 1, wherein the first temperature corresponds to room temperature.

4. The method according to claim 1, wherein the second temperature corresponds to a temperature between 50° C. and 100° C.

5. The method according to claim 1, wherein the microwave filter is a microwave cavity filter having multiple resonant filter cavities.

6. The method according to claim 5, wherein the multiple resonant filter cavities are defined by a wall structure of a housing of the microwave filter and are electromagnetically coupled by openings in the wall structure.

7. The method according to claim 1, wherein parameters of a scattering matrix are determined and stored for each temperature when measuring the frequency responses at the different temperatures.

8. The method according to claim 1, wherein each resonant filter element is associated with one tuning mechanism.

9. The method according to claim 8, wherein the tuning mechanism of each resonant filter element comprises one tuning element arranged on a housing of the resonant filter element, wherein the temperature drift of the associated resonant filter element is compensated for by selecting the material and/or shape of the tuning element.

10. The method according to claim 8, wherein the tuning mechanism of one of the multiple resonant filter elements comprises at least two tuning elements arranged on a housing of the resonant one of the multiple filter elements and each extending into a cavity of the resonant one of the multiple filter elements with a shaft portion, wherein the at least two tuning elements each are movable with respect to the housing along an adjustment direction to adjust a length of the shaft portion extending into the housing.

11. The method according to claim 10, wherein the at least two tuning elements are movable with respect to the housing independent of each other.

* * * * *